US012012191B2

(12) United States Patent
Cadalen et al.

(10) Patent No.: US 12,012,191 B2
(45) Date of Patent: Jun. 18, 2024

(54) DOCKING DEVICE FOR AN UNDERWATER VEHICLE

(71) Applicant: THALES, Courbevoie (FR)

(72) Inventors: François Cadalen, Brest (FR); Olivier Jezequel, Brest (FR); Michaël Jourdan, Brest (FR)

(73) Assignee: THALES, Courbevoie (FR)

( * ) Notice: Subject to any disclaimer, the term of this patent is extended or adjusted under 35 U.S.C. 154(b) by 613 days.

(21) Appl. No.: 17/417,368

(22) PCT Filed: Dec. 20, 2019

(86) PCT No.: PCT/EP2019/086621
§ 371 (c)(1),
(2) Date: Jan. 13, 2022

(87) PCT Pub. No.: WO2020/136114
PCT Pub. Date: Jul. 2, 2020

(65) Prior Publication Data

US 2022/0161913 A1 May 26, 2022

(30) Foreign Application Priority Data

Dec. 28, 2018 (FR) ..... 1874296

(51) Int. Cl.
*B63G 8/42* (2006.01)
*B63B 21/66* (2006.01)
(Continued)

(52) U.S. Cl.
CPC ..... *B63G 8/42* (2013.01); *B63B 21/66* (2013.01); *B63C 7/20* (2013.01); *B63G 8/39* (2013.01)

(58) Field of Classification Search
CPC ... B63G 8/00; B63G 8/18; B63G 8/39; B63G 8/41; B63G 8/42; B63B 21/00;
(Continued)

(56) References Cited

U.S. PATENT DOCUMENTS 1,346,551 A 7/1920 Hammond et al.
3,137,264 A 6/1964 Brainard, II et al.
(Continued)

FOREIGN PATENT DOCUMENTS

AU 2013 248 499 B2 10/2013
FR 2 931 792 A1 12/2009
(Continued)

OTHER PUBLICATIONS

Notification of Reason(s) for Refusal issued in Japanese Patent Application No. JP2021-534735 dated Jun. 27, 2023, with English translation.

*Primary Examiner* — Lars A Olson
(74) *Attorney, Agent, or Firm* — BakerHostetler

(57) ABSTRACT

A docking device includes a docking station capable of being connected to a carrying vessel by means of a cable, the docking station comprising a guide device which comprises a set of arms which are connected to the body and each comprise a distal end and a proximal end, the set of arms being capable of being in a deployed configuration wherein it defines a space flaring towards the rear so as to enable the underwater vehicle to be guided to the stop, the distal end of each arm being located behind the proximal end of the arm in the deployed configuration, the set of arms being capable of being in a collapsed configuration wherein a distal end of each arm of the set of arms is closer to the longitudinal axis than in the deployed configuration and wherein the distal end is located in front of the position occupied by the distal end in the deployed configuration, such that a length, along the axis x, of a space defined by the set of arms behind the
(Continued)

stop is smaller in the collapsed configuration than in the deployed configuration.

14 Claims, 10 Drawing Sheets

(51) Int. Cl.
*B63C 7/20* (2006.01)
*B63G 8/39* (2006.01)

(58) Field of Classification Search
CPC ..... B63B 21/56; B63B 21/66; B63B 27/00; B63B 27/36; B63C 7/00; B63C 7/20
USPC ..... 114/244; 701/21
See application file for complete search history.

(56) References Cited

U.S. PATENT DOCUMENTS

| | | | | |
|---|---|---|---|---|
| 8,590,476 | B2 * | 11/2013 | Goudeau | B63B 27/36 701/21 |
| 9,120,544 | B2 * | 9/2015 | Licht | B63G 8/001 |
| 10,351,212 | B2 * | 7/2019 | Jourdan | B63G 8/42 |
| 11,414,163 | B2 * | 8/2022 | Cadalen | B63G 8/42 |
| 2011/0192338 | A1 | 8/2011 | Goudeau et al. | |
| 2014/0331910 | A1 | 11/2014 | Licht | |
| 2016/0009344 | A1 | 1/2016 | Jourdan et al. | |

FOREIGN PATENT DOCUMENTS

| | | | |
|---|---|---|---|
| JP | 2016-515060 | A | 5/2016 |
| KR | 10-2010-0121088 | A | 11/2010 |

* cited by examiner

DOCKING DEVICE FOR AN UNDERWATER VEHICLE

CROSS-REFERENCE TO RELATED APPLICATIONS

This application is a National Stage of International patent application PCT/EP2019/086621, filed on Dec. 20, 2019, which claims priority to foreign French patent application No. FR 1874296, filed on Dec. 28, 2018, the disclosures of which are incorporated by reference in their entirety.

FIELD OF THE INVENTION

The field of the invention is that of the devices and methods for handling an autonomous underwater vehicle or AUV to facilitate its recovery onboard a carrying vessel, in a developed sea. The carrying vessel is, for example, a surface ship or a submarine.

BACKGROUND

In a developed sea, the carrying vessel and the AUV that is to be recovered onboard the carrying vessel are, unless than are fitted with costly stabilizers, subject to high-amplitude movements. The movements, associated with the swell, are random.

Furthermore, the maneuvering capabilities are limited: the AUV has very little power, especially at the end of its mission because its autonomy is optimized with regard to its energy carrying capacity. The carrying vessel is able to maneuver but the maneuvers are heavy and time consuming. The techniques employed for recovering AUVs onboard a carrying vessel can be categorized into 2 broad families.

In solutions involving directly capturing the AUV and directly recovering it onboard the carrying vessel, the AUV is "caught" directly from the carrying vessel using a cage, a landing net or a gripper for example, or else the AUV positions itself in a "zone" dedicated to recovery by the carrying vessel and in the vicinity of the latter. These solutions are relatively simple to implement in calm seas, but the level of risks to the hardware, and even to the operators, is extremely high as soon as the sea becomes developed.

In earlier capture solutions, the AUV is captured by a capture station in such a way that a link is created between the carrying vessel and the AUV, then the capture station and the AUV are recovered onboard the carrying vessel. That solution is used as a matter of preference in developed seas, because the risk of collision with the ship is largely reduced if not eliminated.

The critical steps in the recovery of an AUV are the step of creating a link between the carrying vessel and the AUV and the step of bringing the AUV onboard the ship. Use is generally made of a lifting tool, of the crane type, available onboard for various lifting operations. This lifting tool allows the AUV connected to a capture station to be simply lifted onboard the carrying vessel from the surface of the water and then set down on the platform of the carrying vessel.

Solutions in which the physical link between the AUV and the carrying vessel are established by means of a flexible link that is attached to the top of the AUV so that it can subsequently be recovered from above using a device of the crane or gantry type, are known.

A solution of that type is disclosed in patent application FR 2931792, filed by the applicant company. That solution comprises a recovery cradle connected to a ship by a flexible link and comprising a body comprising receiving means having a flared shape able to accept the nose of the underwater vehicle, and against which the nose of the AUV comes into abutment during a docking-together step. The cradle comprises a dorsal beam extending above the AUV once the AUV has completed the docking-together step. The cradle is intended to be suspended from a cable in a position in which the beam is horizontal at a predetermined depth so as to dock with the AUV. The cradle comprises blocking means allowing the AUV to be secured to the beam once the AUV has completed the docking-together step.

This solution allows the intervention, which could prove tricky in foul weather, of an operator for establishing the link between the ship and the autonomous underwater vehicle to be avoided.

When the nose is housed in the receiving means and in abutment against these means, under the action of the movement imparted by the AUV and of the inertia of the cradle, the latter adopts a rotational movement in the horizontal plane and the vertical plane, which movement has the effect of aligning the axis of the beam with the axis of the AUV and of moving the beam closer to the wall of the AUV. The pressing of the dorsal beam against the wall of the AUV is thus achieved through a dynamic effect of the impact between the AUV and the receiving means. This requires that the AUV be kept in motion at the moment of the impact. That makes that this pressing-together is transitory. The cradle returns to its horizontal position at the same depth after the effect of the impact. Now, because the AUV has to exhibit a longitudinal pitch (most commonly referred to simply as "pitch") that is positive in order to be able to come into abutment against the receiving means without being impeded by the dorsal beam, the dorsal beam moves away from the AUV after the effect of the impact. The blocking of the AUV therefore has to be performed as soon as the axes of the AUV and of the body become aligned in order to secure the AUV to the body before the docking device returns to its initial inclination. The probability of failure to immobilize is high. Furthermore, the pressing of the dorsal beam against the vehicle is obtained only if the speed of the AUV is sufficient high at the moment of docking-together, and this means that the AUV is compelled to conserve enough energy for the docking-together step, thus limiting the duration of its mission.

Furthermore, the space delimited by the receiving means is limited and the AUV has to be controlled very accurately in order for it to be able to position its nose in the receiving means, and this represents a not-insignificant disadvantage in the event of foul weather.

SUMMARY OF THE INVENTION

It is an object of the invention to limit at least one of the aforementioned disadvantages.

To this end, one subject of the invention is a docking device for an underwater vehicle, the docking device comprising a docking station able to be connected to a carrying vessel, the docking station comprising a body comprising a stop allowing a movement of the underwater vehicle with respect to the body along a longitudinal axis passing through the stop to be blocked, in a direction directed from the rear forward defined by the longitudinal axis, the docking station comprising a guiding device for guiding the underwater vehicle toward the stop, the guiding device comprising a set of arms which are connected to the body and each comprising a distal end and a proximal end, the arms being distributed around the stop, the set of arms being able to be in a deployed configuration in which it delimits a volume that flares toward the rear so as to allow the underwater vehicle to be guided toward the stop, the distal end of each arm being situated behind the proximal end of the arm in the deployed configuration, the set of arms being able to be in a furled configuration in which a distal end of each arm of the set is closer to the longitudinal axis than in the deployed configuration and in which the distal end is situated forward of the position occupied by the distal end in the deployed configuration so that a length, along the axis x, of a volume delimited by the set of arms behind the stop is shorter in the furled configuration than in the deployed configuration.

Advantageously, the docking station comprises locking means allowing the underwater vehicle, butting against the stop to be secured to the body.

In a first embodiment, at least one arm of the set is mounted with the ability to slip with respect to the stop along the axis in such a way that the arm experiences a forward translational movement with respect to the stop during the transition from the deployed configuration to the furled configuration.

Advantageously, the proximal end of the arm is mounted with the ability to pivot on a slider mounted with the ability to slide with respect to the stop along in such a way that the distal end is able to move closer to the axis x, through the rotation of the arm with respect to the slider, as the slider advances along the axis during the transition from the deployed configuration to the furled configuration.

In a second embodiment, the proximal end of at least one arm of the set is fixed in terms of translation along the longitudinal axis with respect to the stop.

Advantageously, the proximal end of the arm is mounted with the ability to pivot with respect to the stop in such a way that the distal end is able to move closer to the axis x and to advance along the axis x, by rotation of the proximal end with respect to the stop during the transition from the deployed configuration to the furled configuration.

Advantageously, the body comprises slots that are elongate along the axis x, accepting the distal ends of the arms in the furled configuration.

Advantageously, the body comprises a beam extending longitudinally parallel to the longitudinal axis rearward away from the stop.

Further features and advantages of the invention will become apparent from reading the detailed description which follows, which is given by way of nonlimiting example, and by reference to the attached drawings in which:

BRIEF DESCRIPTION OF THE DRAWINGS

From one figure to another, the same elements are identified by the same references.

DETAILED DESCRIPTION

Figure 1:
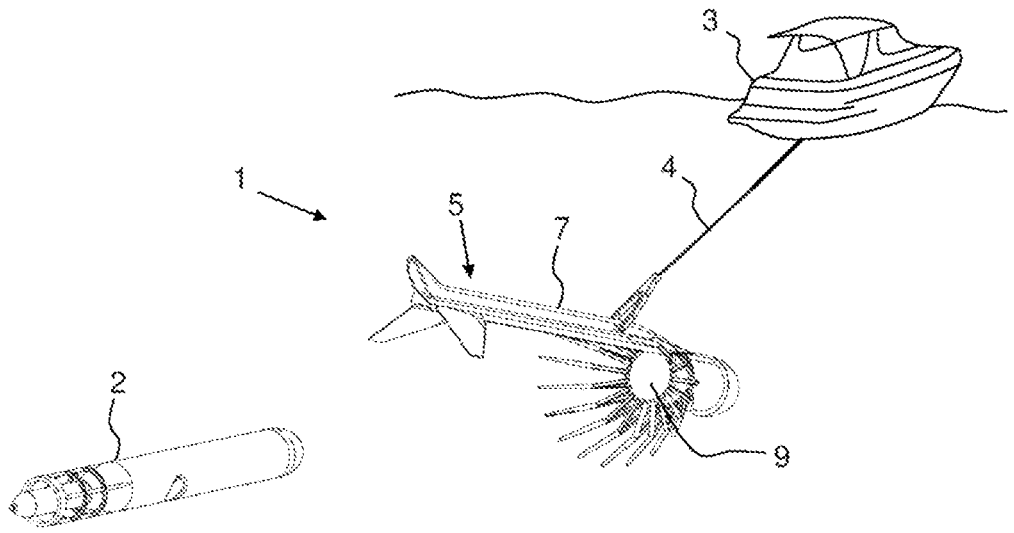
FIG. 1 schematically depicts a docking device according to the invention, hauled by a carrying vessel and approached by an AUV, FIG. 2*a* schematically depicts in side view a docking station having a negative docking pitch, being approached by the AUV and having a set of arms in a deployed configuration, FIG. 2*b* schematically depicts in rear view the docking station in the configuration of FIG. 2*a*, FIG. 3 schematically depicts, in perspective, a phase of the AUV docking-together with the docking station 5, FIG. 4 schematically depicts, in perspective, a phase of the docking station being pressed against the AUV in abutment against a stop of the docking station, FIG. 5 schematically depicts, in rear view, the docking station 5 pressed against the AUV in abutment against the stop, FIG. 6 schematically depicts in plan view a partial view of FIG. 5, FIG. 7*a* schematically depicts in side view the docking station 5 pressed against the AUV in abutment against the stop with the set of arms in the furled configuration, FIG. 7*b* schematically depicts a plan view of FIG. 7*a*, FIG. 7*c* schematically depicts one example of locking means, FIG. 8*a* schematically depicts handling means, the docking station bearing against a support of the handling means, FIG. 8*b* schematically depicts the handling means after pivoting with respect to FIG. 8*a*, FIGS. 9*a* to 9*d* schematically depict a series of steps through which the guiding device according to one example of a first embodiment passes, in order to transition from the deployed configuration to the furled configuration, FIGS. 10*a* to 10*e* schematically depict a series of steps through which the guiding device according to a second embodiment passes, in order to transition from the deployed configuration to the furled configuration.

FIG. 1 schematically depicts a docking device 1 according to the invention approached by an autonomous underwater vehicle AUV 2 and towed by a carrying vessel 3 which may be a surface ship, namely one intended to navigate on a water surface, or a submarine. The docking device 1 is able to establish a link between the carrying vessel 3 and the AUV 2, via a cable 4 connecting the docking station 5 to the carrying vessel 3.

The cable 4 advantageously belongs to the docking device 1. It may be intended to be connected to the docking station 5.

The docking device 1 comprises a submersible docking station 5 intended to be mechanically connected to the carrying vessel 3 in such a way that the carrying vessel 3 hauls the fully submerged docking station 5 via the top of the docking station.

For example, the carrying vessel 3 is intended to be situated at a shallower depth than the docking station 5, although this is not compulsory, the important point being that the hauling point Tb of the cable on the carrying vessel 3 be at a shallower depth than the hauling point T of the cable on the docking station 5. What is meant by the hauling point, also known as the "tow point", is the point at which the cable is intended to exert a pulling force.

The docking device 1 comprises, for example, a connecting element 40 connected to the docking station 5 and able to collaborate with the cable 4 in such a way as to allow the docking station 5 to be connected to the carrying vessel 3 via the cable 4. The cable 4 is therefore fixed to the connecting element 40. The connecting element 40 absorbs the pulling force F exerted by the cable 4 on the body 7 of the docking station 5.

Figure 2A:
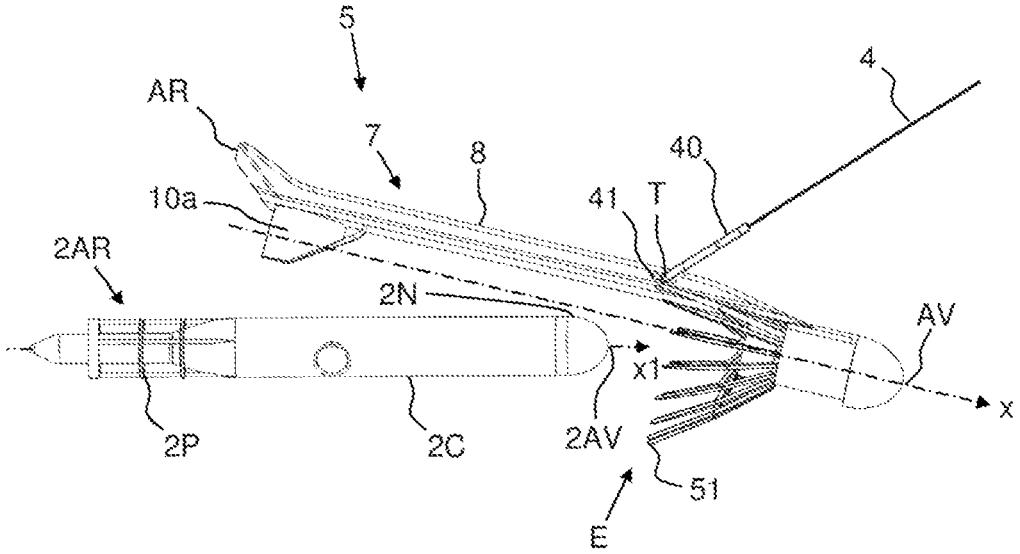

As visible in FIG. 2*a*, the AUV 2 extends longitudinally along a longitudinal axis x1 of the AUV from a rear part 2AR as far as a nose 2N comprising the front end 2AV of the AUV 2. The AUV 2 is intended to move chiefly along the axis x1, in the direction leading from the rear part 2AR the rear toward the front end 2AV of the underwater vehicle 2.

The nose 2N has a shape that is flared in the direction from the front end 2AV toward the rear part 2AR. This shape is, for example, convex. It, for example, exhibits symmetry of revolution about its longitudinal axis x1. It is, for example, hemispherical overall.

The AUV 2 comprises a central part 2C that is cylindrical overall with the axis x1 of the cylinder connecting the nose 2N to the rear part 2AR. The rear part 2AR comprises a thruster 2P intended to propel the AUV 2.

The body 7 of the docking station 5 extends longitudinally along a longitudinal axis x of the body 7 from a rear end AR as far as a front end AV. The axis x extends in the direction of the rear AR toward the front AV. The body 7 comprises a beam 8 extending longitudinally parallel to the axis x.

In the remainder of the text, the terms front, in front of, rear and behind are defined in the direction of the axis x. Top and bottom are defined according to a vertical axis of an earth frame of reference.

The body 7 also comprises a stop 9. The beam 8 extends longitudinally from a rear end of the beam 8 toward the stop 9, for example as far as the stop 9. The stop 9 is solid with the beam 8.

Figure 2B:
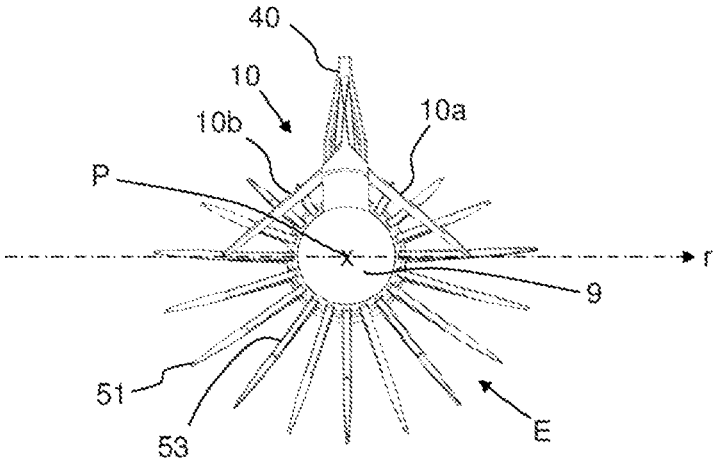

As visible in FIG. 2*b*, which depicts a rear view of the docking station 5 in the position of FIG. 2*a*, the stop 9 has, for example, a shape that is concave so as to be able to accept the nose 2N of the AUV. The shape of the stop 9 is, for example, a shape that complements that as part of the nose 2N comprising the front end 2AV. This shape is nonlimiting; it could, for example, as a variant, have the shape of a ring, the shape of a plate perpendicular to the axis x. The stop 9 may extend continuously over its entire surface or else may have at least one opening (it may for example have a latticework structure); it may have a fixed shape or may be deformable under the effect of the pressure of the AUV bearing against it.

Figure 3:
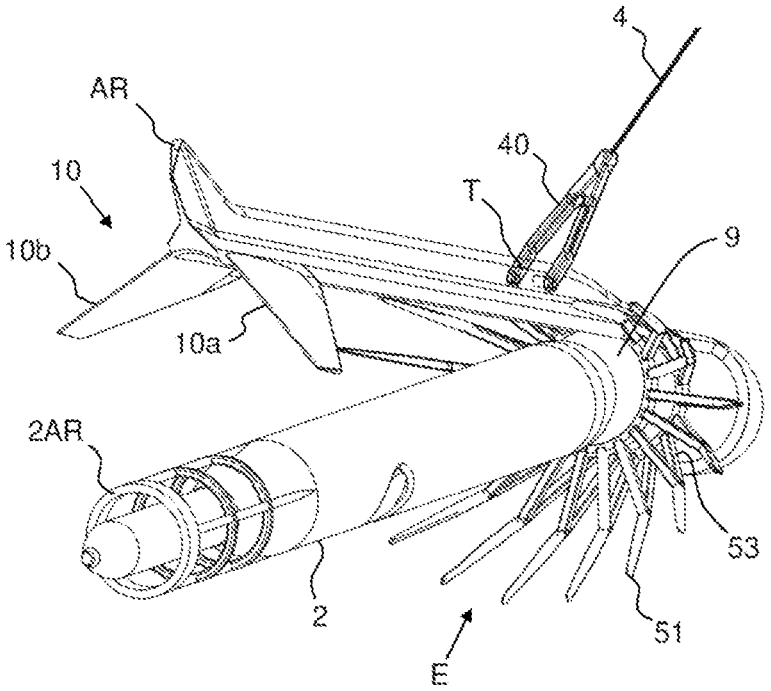

The stop 9 is able to block the movement of the AUV with respect to the body 7 along the axis x passing through the stop 9 in the direction defined by the axis x (namely toward the front AV of the docking station 5) when the nose 2N of the AUV comes to bear against the stop 9, during a docking-together phase depicted in FIG. 3.

The beam 8 diverges from the stop 9 toward the end AR of the body 7 of the docking station 5. In that way, the beam 8 extends facing the AUV 2 when the AUV 2 is in abutment against the stop 9. More specifically, the beam 8 extends facing a part of the AUV 2 which part is situated behind the nose 2N in abutment against the stop 9. The AUV 2 advances along the beam 8 toward the stop 9 in order to come to bear against the stop 9.

In the embodiment depicted in the figures, the beam 8 and the stop 9 are arranged relative to one another in such a way that the beam 8 extends above the AUV 2 when the nose 2N of the AUV 2 is in abutment against the stop 9.

The buoyancy acting on the body is the resultant of the difference between the Archimedean upthrust and the weight of the body. This force may be directed upward (positive buoyancy, weight less than Archimedean upthrust) or downward (negative buoyancy, weight greater than Archimedean upthrust). The fully submerged docking station 5 advantageously has negative buoyancy in the liquid in which it moves, for example freshwater or seawater. The docking station 5 is therefore heavy. The negative buoyancy of the docking station has a positive effect on achieving, as it desired and described later on the text, a pressing of the docking station against the AUV, because the station has a tendency to sink. This configuration offers the advantage of avoiding the need to provide means or a hydrodynamic configuration for causing the station to dive, such as, for example, means for adjusting the buoyancy of the station or adjustable orientation fins, which are means that are expensive and restrictive.

In a variant, the docking station 5 has zero or positive buoyancy.

It should be noted that the docking station 5 is intended to be hauled by the carrying vessel 3, in the direction from the rear AR toward the front AV, when the AUV 2 approaches the stop. Thus, the axis x has a preferred direction thereby allowing the AUV to reach the stop more easily.

Advantageously, the docking station 5 is hydrodynamically profiled and has a center of gravity and a center of buoyancy which are arranged in a particular way, and the tow point T is able to occupy a position defined in a particular way such that the docking station 5 has negative predetermined docking pitch (the front end AV situated at a greater depth than the rear end AR) when the docking station 5 is fully submerged and hauled by the carrying vessel 3 from the top at a positive predetermined speed in the direction of the longitudinal axis x, as depicted in FIGS. 1, 2*a* and 2*b* and 3. The pitch of the docking station 5 is the pitch of the body 7 of the docking station on which the pull of the cable is exerted.

The docking pitch is fixed when the speed is fixed.

The position of center of buoyancy of the fully submerged docking station 5 is defined by the shape of the docking station and the position of its center of gravity is defined by the distribution of the mass of the docking station 5.

It may be seen from FIGS. 1, 2*a*, 2*b* and 3 that, with a negative pitch, the docking station 5 is in a position favorable to docking-together, thereby allowing the AUV 2 to come into abutment against the stop 9 with a wide tolerance on the path of the AUV 2.

The risks of the AUV 2 striking the beam 8 (and particularly the end AR) during docking-together are low. This solution means that the adjusting of ballasts or docking-together with an upward velocity of the AUV 2, which would add to the complexity of the docking-together phase can be avoided. The proposed solution is therefore robust and economical. The beam also has a function of guiding the AUV 2.

In order to attain the docking negative pitch, the tow point T is able to occupy a docking position situated behind the point at which the resultant of gravity, the Archimedean upthrust and the hydrodynamic force is applied.

The position of the tow point T with respect to the body 7 along the axis x may be fixed or variable as will be seen later. In the case of the tow point T having a variable position with respect to the body 7 along the axis x, at least one of its positions along the axis x is defined in such a way as to allow the docking pitch to be obtained.

Advantageously, the docking station 5 is hydrodynamically profiled in such a way that the resultant of the thrust generated by the part of the docking station situated behind the docking position of the tow point is oriented downward or is zero, when the fully submerged docking station is being towed by a surface vessel in the direction from the rear AR toward the front AV. The docking station 5 is then also in a position of equilibrium in terms of roll (zero list). Thus, the docking negative pitch is obtained chiefly through hydrostatic forces. In this way, the tow point is advantageously able to occupy a docking position situated behind the point at which the resultant of the gravity and the Archimedean upthrust is applied.

As a preference, the tow point T is able to occupy a tow point position situated behind the center of gravity.

Advantageously, the docking device is configured so that the tow point T occupies its docking position when the fully submerged docking station is being hauled by the carrying vessel 3 before the AUV 2 comes into abutment against the stop.

Figure 4:
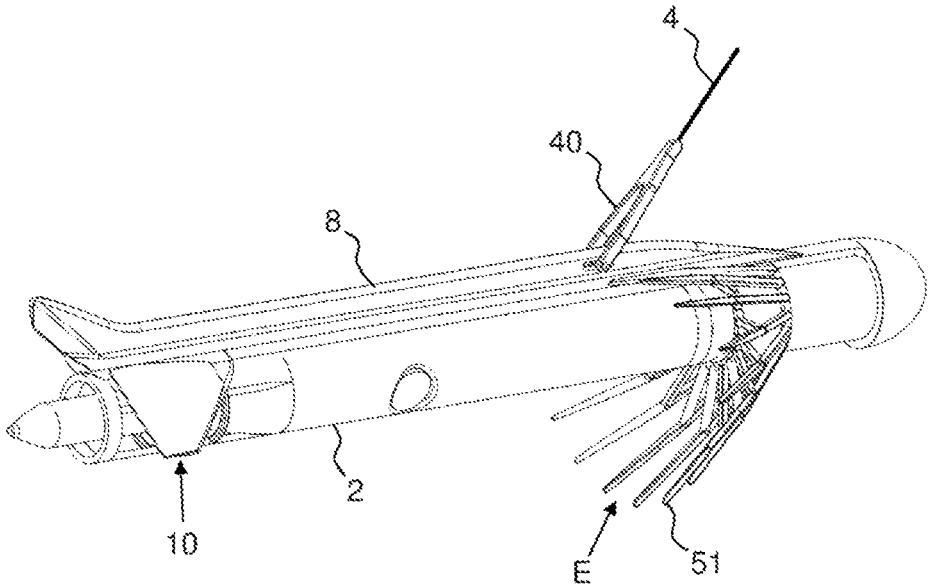

When the AUV 2 comes into abutment against the stop 9, as visible in FIG. 3, the beam 8 presses against the AUV 2 during a pressing-together phase, as visible in FIG. 4, under the action of a dynamic effect caused by the forward movement imparted by the AUV in abutment against the stop 9. This pressing-together is obtained by a rotational movement of the docking station 5 and of the beam 8 in the vertical plane.

The docking device comprises locking means, for example a set of at least one latch, allowing the body 7 to be secured to the AUV 2 when the beam 8 is bearing against the AUV 2. The AUV 2 is then connected to the carrying vessel 3 via the cable 4.

Locking takes place during a capture phase that comes later than the pressing-together phase.

When the AUV 2 comes into abutment against the stop 9, the docking station 5 is driven forward by the AUV 2, along the axis x, and this has the effect of relaxing the cable 4 which no longer pulls on the docking station 5.

Advantageously, the docking station is hydrodynamically configured and has a center of gravity and a center of buoyancy which are positioned in such a way that a first return torque is applied to the fully submerged docking station 5 having the docking pitch when the AUV 2 is in abutment against a point P of the stop 9, as depicted in FIG. 3, so as to press the dorsal beam 8 against the AUV 2 through rotation of the docking station 5 with respect to the AUV 2 in a vertical plane defined in the earth frame of reference.

The docking pitch is advantageously comprised between −15° and −5°.

Thus, the dorsal beam 8 comes to press against the AUV, as depicted in FIG. 4, in a lasting manner. This lasting pressing allows enough time for the AUV 2 to be secured to the body 7 during a capture phase. The risk of failed capture of the AUV is thus limited. This solution allows the pressing of the dorsal beam 8 against the AUV 2 to be achieved even if the speed of the AUV 2 at the time of docking-together is low; all that is needed is for the AUV 2 to be going slightly faster than the docking station 5 at the moment of docking-together, so as to drive the docking station 5 forward and relax the cable 4. Once the cable 4 is relaxed, the first hydrostatic torque presses the dorsal beam onto the AUV 2. This solution is advantageous because the AUV 2 generally has a limited reserve of energy at the end of a mission, at the time of docking-together. A maximum quantity of energy can thus be used during the mission, the duration of which can thus be increased.

The lasting-pressing effect is obtained when the pitch of the AUV 2 is greater than that of the docking station 5. The pressing effect is therefore obtained particularly when the AUV 2 starts to dock-together with the docking station 5 with its longitudinal axis x1 horizontal for example.

Advantageously, the docking station is configured in such a way as to experience a first return torque when its pitch is zero (axis x horizontal) and the beam 8 is bearing against the AUV 2 so as to tend to press the beam 8 against the AUV. That makes it possible to achieve lasting pressing.

Once the AUV is bearing against the stop, the moments applied to the docking station 5 are no longer balanced about the tow point but about the point P of the stop 9, against which the AUV 2 is in abutment. The first return torque is therefore exerted about a horizontal axis of rotation r depicted in FIG. 2*b* passing through the stop 9, for example through the point P via which the AUV 2 bears against the stop 9 in the direction depicted in FIG. 3. This point P is a stop point.

Le point P is, for example, the point at which the resultant of the force of the vehicle bearing against the stop 9 is intended to be exerted when the axes x and x1 are parallel.

The first return torque has a tendency to cause the beam 8 to rotate about the axis of rotation r so as to lower the rear end AR with respect to the stop 9.

In order to obtain the return torque that ensures the lasting passing, the docking position of the tow point T is advantageously to the rear of the stop 9, preferably to the rear of the point P. This solution is simple and avoids the need to provide complex means employing hydrodynamics in order to obtain the first return torque.

Advantageously, the docking station is hydrodynamically profiled in such a way that the effect of the hydrodynamic forces on the pressing-together is negligible, namely that the resultant of the moments of the hydrodynamic forces with respect to the stop is substantially zero when the docking station exhibits the docking pitch and/or a zero pitch. The first return torque is then substantially a first hydrostatic return torque. In such cases, lasting pressing is then independent of the speed (difference between the horizontal speed of the AUV and the speed at which the docking station is being hauled at the moment at which the AUV comes into abutment against the stop 9) and is achieved even when the speed is high.

A negligible hydrodynamic effect may, for example, be obtained by providing a set of at least one rear empennage situated near the rear AR of the station and configured to generate downward thrust. The empennage needs to be dimensioned for this purpose as a function of the rest of the docking station.

In all cases, the docking station advantageously has a center of gravity and a center of buoyancy that are positioned in such a way that a first hydrostatic return torque is exerted on the fully submerged docking station 5 exhibiting the docking pitch when the AUV 2 is in abutment against the stop 9, as depicted in FIG. 3, so as to press the dorsal beam 8 against the AUV 2 by rotation of the docking station 5 with respect to the AUV 2 in a vertical plane defined in the earth frame of reference. That ensures lasting pressing, at least at low speed.

The first hydrostatic return torque experienced by the docking station 5 about the axis of rotation r passing through P is the sum of the torque associated with gravity exerted on the docking station 5 about that same axis and of the torque associated with the Archimedean upthrust exerted on the docking station 5 about that same axis. Thus, in order to obtain the pressing-together effect, the shape of the docking station 5 and the mass distribution of this docking station 5 are defined in such a way that the positions of the center of gravity and of the center of buoyancy of the docking station 5 give rise to this first hydrostatic return torque. The mass of the docking station 5 generates a downward force applied at the center of gravity and the volume generates an upward force (the Archimedean upthrust) applied at the center of buoyancy. This solution offers the advantage of being simple, reliable and inexpensive. As it is passive, this solution does not require any variable-density equalizing device of the ballast type in order to ensure the pressing-together against the AUV.

Advantageously, the center of gravity and the center of buoyancy of the body 7 of the fully submerged docking station 5 occupy fixed positions.

One of the possible options for obtaining the first hydrostatic torque which ensures the desired pressing-together, is for the docking station 5 to be configured in such a way that the center of gravity of the docking station 5, and possibly that of the body 7, is positioned behind the stop 9 or behind the point P.

The position of the center of buoyancy of the docking station 5, and optionally that of the body 7, may be situated in front of the stop 9 or in front of the point P along the longitudinal axis x of the docking station 5. However, the position of the center of buoyancy has a significant effect only if the docking station is not very heavy. When the docking station is very heavy, a center of buoyancy situated behind the stop or even behind the center of gravity may be envisioned.

Advantageously, the centers of gravity and of buoyancy are positioned in such a way that the docking station always experiences the first hydrostatic return torque when its pitch is zero (axis x horizontal) and the beam 8 is bearing against the AUV 2.

It should be noted that the first return torque or the first hydrostatic return torque is applied to the docking station when the cable is not applying any pull to the docking station 5. The docking station 5 is then pushed forward by the AUV. The cable is slack. The docking station 5 may experience, but no longer necessarily experiences, this first return torque or this first hydrostatic return torque when the cable is once again hauling the docking station 5.

Figure 5:
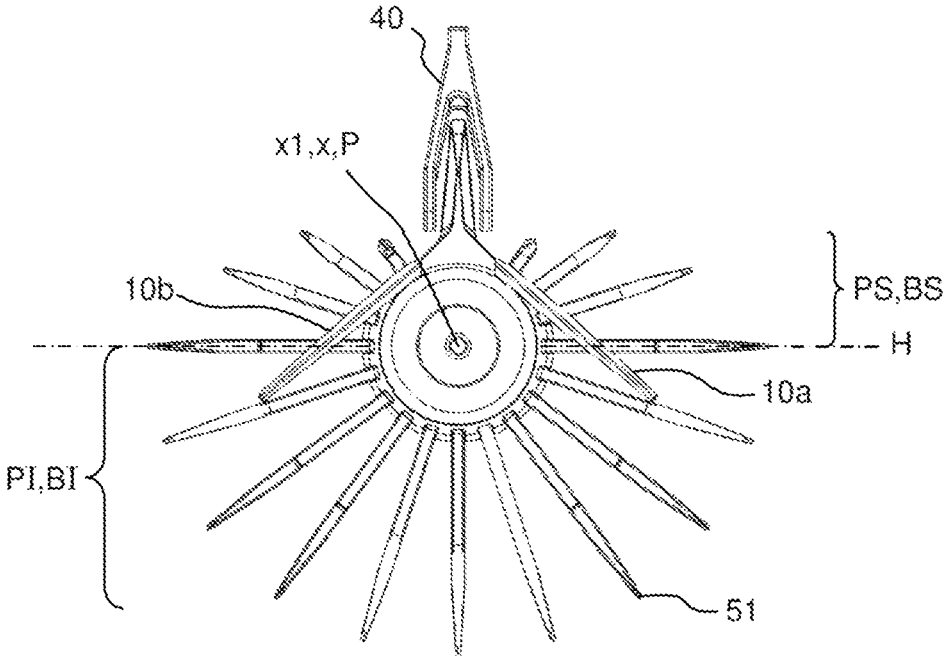

As visible in FIGS. 3 and 5, the body 7 may comprise an empennage 10 situated behind the stop 9. The empennage 10 is positioned near the rear end of the beam 8 or at the end of the beam 8, near the rear AR of the body 7. This empennage is configured to generate downward thrust. It is then possible to alter the density of the empennage in order to alter the position of the center of gravity of the station.

In the nonlimiting embodiments of the figures, the body 7 of the docking station 5 comprises an empennage 10 in the shape of an inverted V comprising two individual empennages 10*a*, 10*b* each forming one of the branches of the inverted V.

Advantageously, although not necessarily, the center of gravity and the center of buoyancy of the docking station 5 or of the body 7 are positioned in such a way that the docking station 5 has a positive pitch in equilibrium when subjected only to Archimedean upthrust and to gravity. That encourages the pressing-together.

In a variant, the pitch in equilibrium is, for example, zero.

FIG. 5 depicts, schematically in rear view, the docking station and the AUV 2 in the configuration of FIG. 4. In this configuration, the AUV 2 is in abutment against the stop 9, its longitudinal axis x1 being coincident with the axis x. The longitudinal axis x passes through the point P. It is intended to bear the reaction of the stop 9 when the AUV 2 is bearing against the stop 9.

Advantageously, the docking station 5 is configured in such a way that its center of gravity and its center of buoyancy are positioned in such a way that when the AUV 2 is in abutment against the stop 9 and the dorsal beam 8 is pressed against the AUV 2, with the docking station 5 fully submerged, a second hydrostatic return torque is applied to the docking station 5 about the longitudinal axis x when the longitudinal axis x is horizontal so that the docking station 5 has a position of stable equilibrium in rotation about the longitudinal axis x with respect to the AUV 2 as depicted in FIGS. 4 and 5. The second hydrostatic return torque prevents the docking station 5 from tilting to the side under static conditions, namely prevents the docking station 5 from rotating with respect to the AUV 2 about the longitudinal axis x. The position of the docking station 5 that is depicted in FIGS. 4 and 5 is stable in terms of rotation about the longitudinal axis x.

Advantageously, the docking station 5 is configured in such a way that its center of gravity and its center of buoyancy are positioned in such a way that when the AUV 2 is in abutment against the stop 9 and the fully submerged docking station 5 exhibits a zero pitch and preferably when the pitch is comprised between a pitch comprised between the docking pitch and a zero pitch, a second hydrostatic return is exerted on the docking station 5 about the longitudinal axis x such that the docking station 5 exhibits a position of stable equilibrium in rotation about the longitudinal axis x with respect to the AUV 2, preventing the docking station 5 from tilting before it has become pressed against the AUV.

Advantageously, the position of stable equilibrium is the position of equilibrium in roll.

This position is, for example, a position of zero list in which a vertical plane comprises the longitudinal axis x which is the axis of roll and constitutes an axis of symmetry of the docking station 5. In the position of equilibrium for roll, the center of gravity and the center of buoyancy lie in the one and the same vertical plane containing the axis x.

In a variant, the docking station 5 has a non-zero list of a few degrees in the position of equilibrium for roll.

This stability with regard to roll makes the recovery of the AUV easier because the station also occupies this position that is stable for roll before docking together with the AUV.

In the nonlimiting embodiment of FIG. 1, the vertical plane is a plane of symmetry of the inverted-V-shaped empennage which straddles the AUV when the docking station is pressed against the AUV, as visible in FIG. 5.

In order to prevent the docking station 5 from tilting to the side, the center of gravity of the docking station 5 is vertically offset with respect to the center of buoyancy of the docking station 5, when the beam 8 is pressed against the AUV in abutment against the stop 9 and the pitch of the docking station is the zero pitch and preferably when it is comprised between the docking pitch and the zero pitch.

To this end, the center of gravity is situated below the center of buoyancy when the pitch of the docking station is zero and preferably when it is comprised between the docking pitch and the zero pitch or at least when the pitch is zero. This allows the position of equilibrium for roll to be achieved when the cable is slack.

In one embodiment of the invention, the center of gravity is situated below the axis x when the pitch of the docking station is comprised between the docking pitch and the zero pitch or at least when the pitch is zero. This solution is simple; it avoids the need to provide a very high center of buoyancy. The center of buoyancy may even likewise be below the axis x (particularly for a heavy-station configuration).

To this end, the docking station 5 (or else the body 7 of the docking station) comprises an upper part PS situated above a horizontal plane H containing the horizontal axis x and a lower part PI situated below the horizontal plane when the docking station 5 is in its position of stable equilibrium. The mass distribution of the docking station 5 is chosen so that the mass of the lower part PI is greater than that of the upper part PS. In that way, the center of gravity is below the axis x. The shape of the docking station is defined so that the center of buoyancy is situated above the center of gravity. The volume of the liquid displaced by the upper part PS may for example be equal to the volume of liquid displaced by the lower part.

In the nonlimiting embodiment of the figures, each individual empennage 10*a*, 10*b* extends from the beam 8 as far as a lower end of the individual empennage 10*a*, 10*b* situated in the lower part PI of the station 5, namely deeper than the axis x when the longitudinal axis is horizontal and the carrying structure 5 is in the position of stable equilibrium. This configuration allows the position of the center of gravity to be lowered. It is possible to alter the mass of the empennages in order to position the center of gravity as low down as possible. It is possible for example to envision fitting ballast weights to the lower end of each individual empennage.

The docking device according to the invention allows a simple, passive and robust capture process.

In a variant, the beam 8 and the stop 9 are arranged relative to one another in such a way that the dorsal beam extends above the AUV 2 when the nose of the AUV is in abutment against the stop 9.

Advantageously, as visible in FIG. 2*a*, the tow point T is able to move along the longitudinal axis (x) with respect to the body 7.

The mobility of the tow point allows the pitch of the docking station to be adapted according to its speed, its status (with or without AUV) or the phase of the mission (capture of the AUV, or recovery of the station onboard the ship). That allows the impact of the movements of the ship associated with the swell to be minimized by releasing or regaining the tension in the cable.

Figure 11:
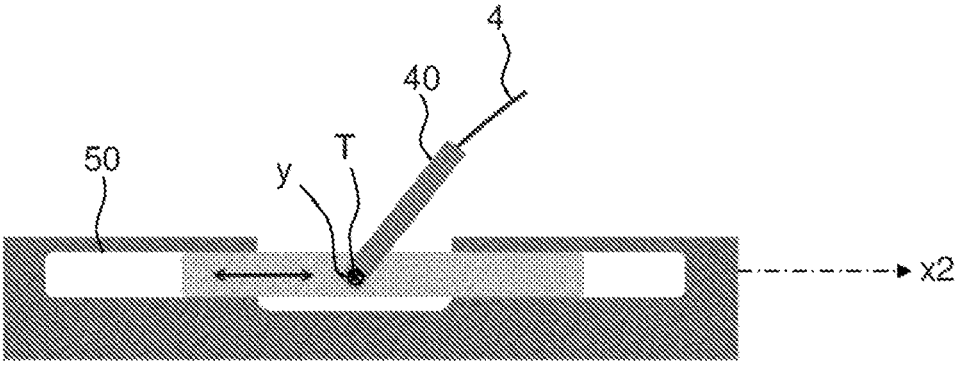
FIG. 11 schematically depicts another example of a connection between the cable and the body of the docking station.

For example, as visible in FIG. 11, the tow point T is able to slide along the axis x with respect to the body 7.

The cable is for example fixed to a yoke 40 mounted with the ability to pivot about an axis of rotation y with respect to the body 7, the axis of rotation y being mounted with the ability to slide with respect to the body 7 along an axis x2 parallel to the longitudinal axis x. For this purpose, the body 7 comprises for example a guide slot 41 extending longitudinally parallel to the axis x and accepting the axis of rotation y.

An actuator, for example a hydraulic ram, an electric ram or a rack system may allow the axis y to be made to slide with respect to the body 7. Note that, unless the dynamic movement is very rapid, the pulling force is always oriented in the same direction along the axis x. A single-acting ram may be sufficient. A double-acting ram may be advantageous if rapid servocontrol is desired.

Advantageously, the cable 4 is connected to the body 7 of the docking station 5 in such a way that the tow point T advances along the axis x with respect to the body 7 when the AUV 2 comes into abutment against the stop 9, for example under the effect of the AUV bearing against the stop 9. In other words, the adjusting means are configured to advance the tow point along the axis x with respect to the body 7 when the AUV 2 comes into abutment against the stop 9. This accelerates the pressing of the beam 8 against the AUV 2 and allows the power requirement of the AUV to be minimized.

Advantageously, the cable 4 is connected to the body 7 of the docking station 5 in such a way that the tow point T is positioned along the axis x with respect to the body 7 in a docking position of the tow point T that is such that the docking station 5 exhibits a negative pitch when the fully submerged docking station is being hauled by the carrying vessel before the AUV comes into abutment with the AUV (before docking-together).

This docking position of the tow point is advantageously behind the stop 9.

The docking device 1 comprises adjusting means for adjusting the position of the tow point T with respect to the body 7 along the axis x. The adjusting means may be passive (without control means of the program type) or active (controlled remotely by an operator or by means of control of the station).

The passive adjusting means may comprise a spring situated to the rear of the tow point, connected to the beam and connected to the tow point which is in a guideway. The position of the tow point, with the spring compressed, is maintained by a catch which is connected to the stop 9 and which is released by the AUV pushing against the stop 9: the spring then relaxes and pushes the tow point forward.

Figure 6:
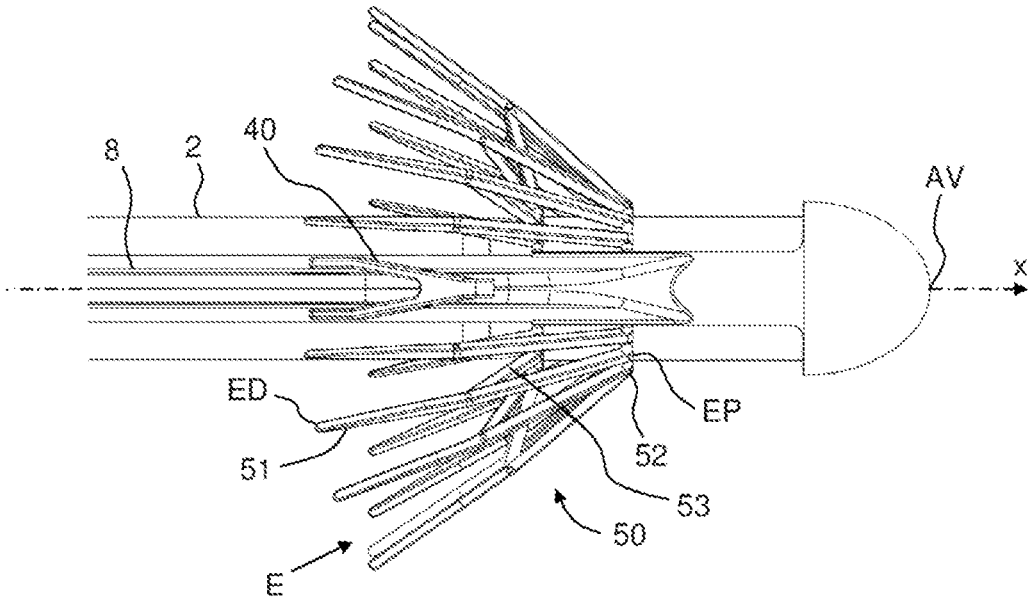

Advantageously, as visible in FIG. 6, the docking station 5 comprises a guiding device 50 comprising a set E of guiding arms 51 arranged around the stop. The set E of arms 51 able to be in a deployed configuration depicted in FIGS. 2*a*, 2*b*, 3, 6*a* and 6*b* in which it is able to guide the AUV 2 toward the stop 9. The deployed configuration of the arms is stable in the absence of an AUV bearing against the guiding structure.

In the deployed configuration, the set of arms delimits a first volume able to receive the nose 2N of the AUV 2 and which flare out away from the stop 9 along the axis x toward the rear so as to be able to guide the AUV 2 toward the stop 9 in order to transition in the configuration of FIG. 1 to that of FIG. 3 during the docking-together phase in which the set E of arms is in the deployed configuration.

As visible in FIGS. 2*a*, 2*b* and 3, the arms 51 are arranged around the stop 9 and angularly distributed about the axis x. Each arm 51 of the set E of arms has a distal end ED and a proximal end EP which have been referenced on just a single arm in FIG. 6 for the sake of greater clarity. Each arm 51 of the set of arms E is connected to the body 7 by its proximal end EP.

In the deployed configuration visible in FIG. 6, the distal end ED of each arm 51 of the set E is situated behind the proximal end EP. In other words, the distal end ED is closer to the rear end AR of the body 7 than a proximal end EP of the arm via which end the arm is connected to the body 7.

The set of arms E may be fixed or may have a single stable configuration which is the deployed configuration.

Figure 7A:
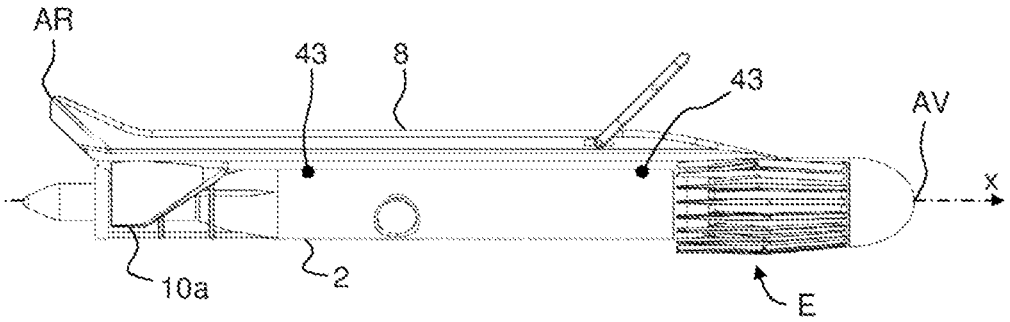
Figure 7B:
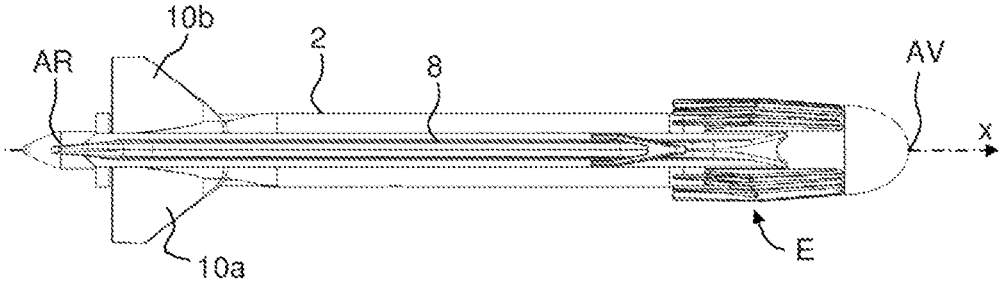

Advantageously, the set of arms 51 is able to be in a furled configuration as visible in FIGS. 7*a* and 7*b*. The arms advantageously transition from the deployed configuration to the furled configuration during a phase of furling the set E which phase is implemented after the docking-together phase and preferably after the phase of pressing-together with and/or capture of the AUV 2.

As visible in FIGS. 7*a* and 7*b*, in the furled configuration, each distal end ED is closer to the axis x than in the deployed configuration. In other words, during the furling of the arms, the distal end ED of each arm 51 moves closer to the axis x from its position in the deployed configuration, until it reaches its furled-configuration position.

The furled configuration allows the docking station 5 to be rendered more compact outside of the docking-together and capture phases so as not to clutter the deck of the carrying ship. It allows arms of substantial length to be provided, which arms may thus, in the deployed configuration, delimit a first volume of substantial size, in a plane referred to as transverse, perpendicular to the axis x, thereby providing guidance of the AUV toward the stop 9 with a wide tolerance on the path of the AUV. It also allows the AUV to be guided over a substantial distance along the axis x.

The docking device comprises locking means able to collaborate with the AUV to secure the AUV to the body 7 of the docking structure 5 during a capture phase. Advantageously, the locking means are configured to allow the body 7 to be secured to the AUV 2 when the arms are in the deployed configuration and/or when the arms are in the furled configuration.

These locking means may be present even in the absence of the guiding device.

Figure 7C:
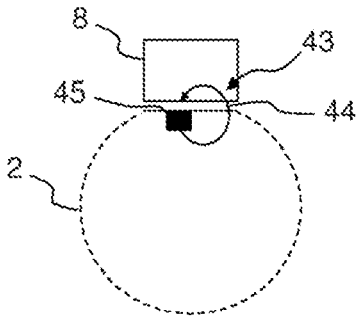

The locking means may comprise at least one latch 43, one example of which is depicted in FIG. 7*c*, comprising a hook 44 able to be in a retracted position retracted inside the body 7, for example inside the beam 8, and in a projecting position depicted in FIG. 7*c*, in which position it is able to enter the body of the AUV to collaborate with an attachment 45 of the AUV in order to keep the body of the station fixed with respect to the body of the AUV. This type of locking means is entirely nonlimiting. The docking station may for example comprise arms able to surround the body of the AUV so as to block the body of the AUV with respect to the body of the docking station 5.

Figure 8A:
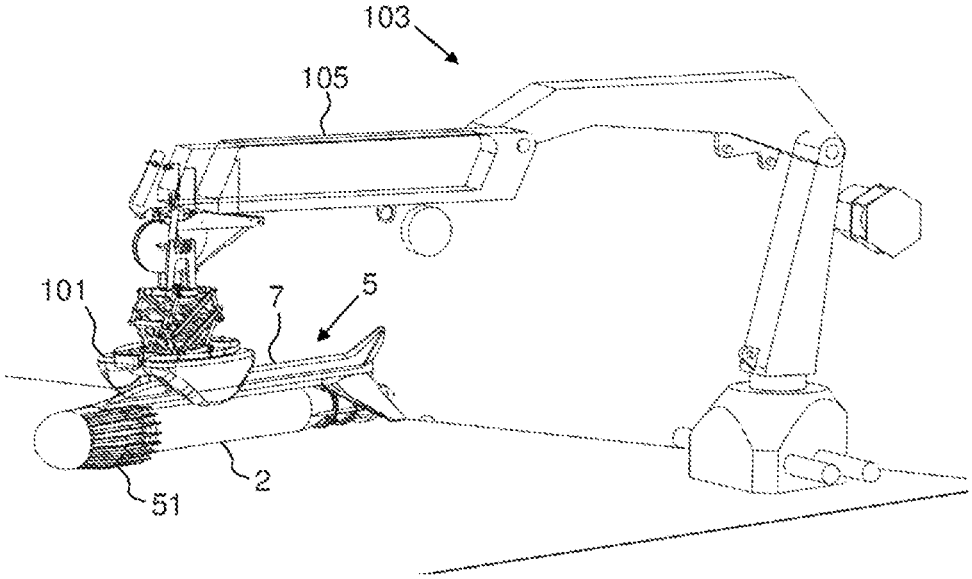
Figure 8B:
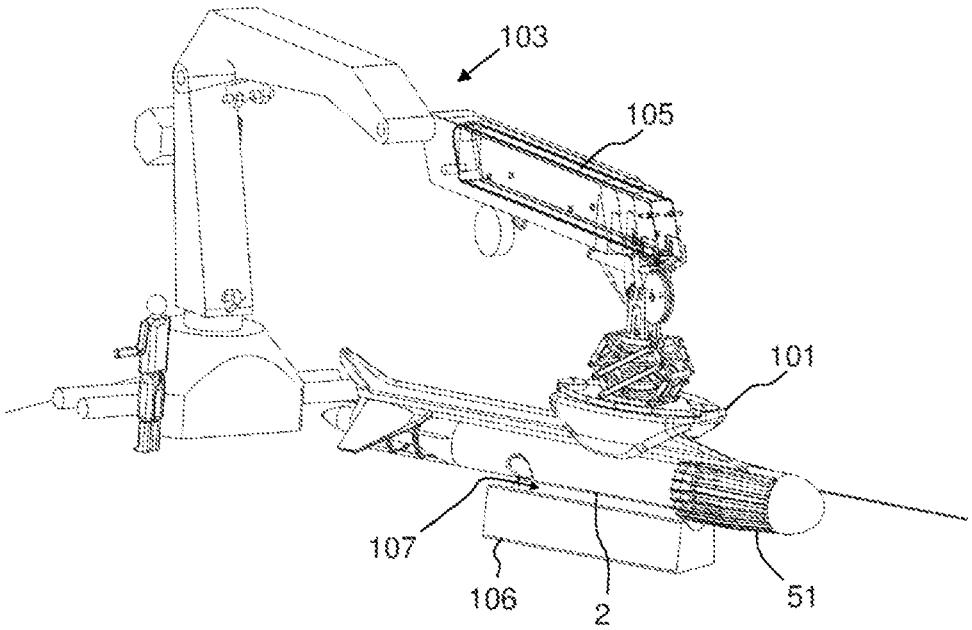

The docking device advantageously forms part of a recovery device 100 comprising handling means 102 depicted in FIG. 8*a* comprising means for hauling in the cable 4, such as a winch for example, during a hauling-in phase subsequent to the capture until the capture station 5 comes to bear against a support 101 of the handling means 102. The support 101 is able to block the translational movement of the capture station and of the AUV secured to the body of the capture station in the upward direction. It may also be able to prevent the vehicle from pivoting about a vertical axis. The handling means 102 further comprise movement means 103 allowing the docking station 5 connected to the AUV and bearing against the support 101 to be moved so that it can be set down on a support of the vehicle 104. The movement means 103 comprise for example a crane from which is suspended the support 101 comprising articulated arms. The movement means comprise drive means for pivoting an arm 105 of the crane, from which arm the support 101 is suspended, about a horizontal axis so as to bring the AUV connected to the capture station 5 to face the support, as depicted in FIG. 8*b*, and means for lowering the support 101 so as to set the AUV connected to the capture station down on a support 106 of the AUV. In the nonlimiting embodiment of FIG. 8*b*, the support 106 has a bearing surface 107 of a shape that more or less complements the central part 2C of the AUV 2, namely in the shape of a portion of a cylinder.

In the furled configuration, the set E of arms 51 delimits a volume of reduced size in the transverse plane thereby allowing the capture station to be handled and stored onboard the carrying ship 3 more easily.

The fact that the set E of arms 51 is furled after the capturing of the AUV 2 makes the AUV 2 easier to handle. Specifically, it is possible to set the AUV 2 down on a support of the vehicle having a simple shape that complements that of the AUV 2, for example the shape of a portion of a cylinder, by bringing all or most of the length of the cylindrical part of the AUV to rest on the support of the vehicle, while limiting the risks of tilting of the AUV liable to be induced by the docking station and thus improving its stability. Furthermore, it is possible to set the AUV down on its support directly using the crane or the gantry used for lifting the docking device. There is no need, beforehand, to detach the AUV from the body 7 of the docking station 5. Handling is thus greatly simplified by comparison with a cage or landing net which requires the tricky step of extracting the AUV from the docking device before setting it down on its support.

The furling of the arms is particularly advantageous in the case of a beam 8 that extends along the top of the AUV, but may also be advantageous in the case of a beam extending along the bottom of the AUV.

Advantageously, each arm 51 of the set E of arms or at least one arm of the set of arms is furled against the body 7 in the furled configuration. This configuration provides a good deal of compactness in the furled configuration and thus improves the stability of the AUV on its support.

Advantageously, each arm 51 of the set E of arms or at least one arm extends longitudinally substantially parallel to the longitudinal axis x in the furled configuration. In other words, the set of arms delimits a volume exhibiting substantially the shape of a portion of a cylinder in the furled configuration. This configuration ensures good compactness in the furled configuration and further improves the stability of the AUV on its support.

In the nonlimiting example of FIGS. 6 to 7*a*, 7*b*, the distal ends ED of the arms 51 are free.

In the furled configuration, each distal end ED is in front of the position it occupies in the deployed configuration. In other words, during the furling of the arms, the distal end ED of each arm 51 advances, along the axis x and in the direction of the axis X, from its position in the deployed configuration as far as its position in the furled configuration.

In this way, the length, along the axis x, of the volume delimited by the set of arms E along the axis x behind the stop 9 is reduced or eliminated if the arms 51 extend entirely forward of the stop 9 in the furled configuration. These particular dynamics of the arms 51 allow the periphery of the AUV 2 to be freed up at least partially after capture, through the furling of the set of arms.

This configuration is particularly advantageous for instances in which the beam is arranged with respect to the stop in such a way as to be intended to be situated above the AUV in abutment against the stop 9. It reduces or avoids the masking of a sensor or of an antenna positioned on the belly or the sides of the AUV, for example a sonar intended to image the seabed. The AUV 2 can therefore continue its mission, for example a sonar imaging mission, even after docking together. This feature is of benefit when the AUV is secured to the docking station 5 only temporarily, for example with a view to recharging its batteries and/or to recover data.

This reasoning also applies to the case of a beam 8 arranged with respect to the stop 9 in such a way as to be intended to be positioned under the AUV in abutment against the stop, for example in order to avoid masking sensors or antennas situated on the top or the sides of the AUV.

Two embodiments of guiding devices are depicted in FIGS. 9*a* to 9*d* and 10*a* to 10*e*.

In a first embodiment, of which an example is depicted in FIGS. 9*a* to 9*d*, the distal end ED of the arm advances forward while constantly remaining behind the proximal end EP, during the transition from the deployed configuration to the furled configuration.

In the nonlimiting example of FIGS. 9*a* to 9*d*, each arm 51 of the set is mounted on the body 7 of the docking station in such a way that the arm 51 advances forward, with respect to the stop 9, during the transition from the deployed configuration to the furled configuration.

Figure 9A:
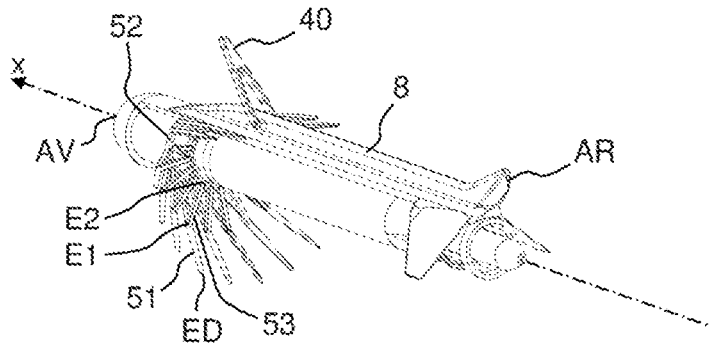
Figure 9B:
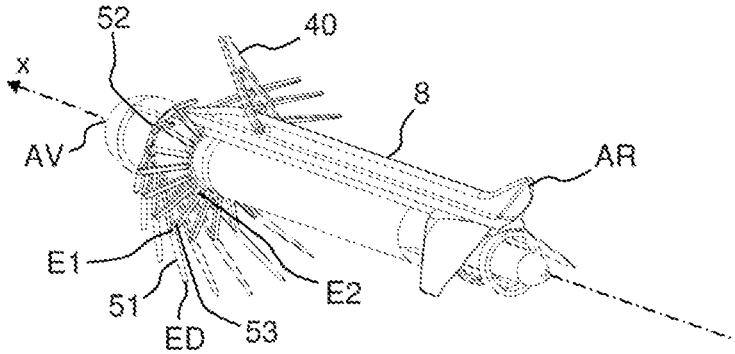
Figure 9C:
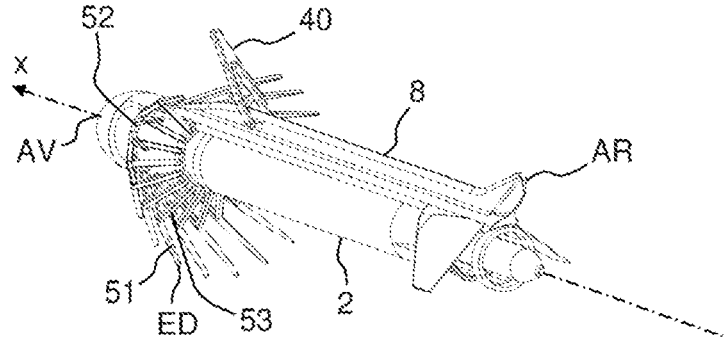
Figure 9D:
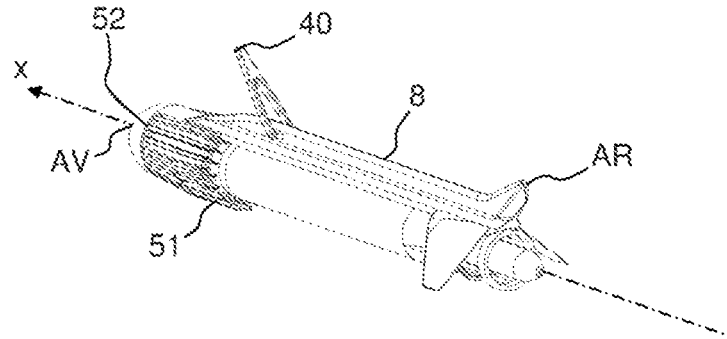

In the nonlimiting example of FIGS. 9*a* to 9*d*, each arm 51 is mounted with the ability to slide with respect to the stop 9 along the axis x in such a way that the arm 51 experiences a forward translational movement, with respect to the stop 9, during the transition from the deployed configuration of FIG. 9*a* to the furled configuration of FIG. 9*d*, via the successive intermediate configurations of the successive FIGS. 9*b* and 9*c*.

Thus, each arm 51, overall, experiences a forward translational movement along the axis x, with respect to the body 7, during the transition from the deployed configuration to the furled configuration. The distal end ED of each arm 51 remains behind its proximal end EP during the transition from the deployed configuration to the furled configuration.

To that end, the proximal end EP of the arm 51 is mounted with the ability to pivot on a slider 52 mounted with the ability to slide with respect to the stop 9 along the axis x in such a way that the distal end ED is able to move closer to the axis x, through the rotation with respect to the slider 52, as the slider 52 advances along the axis x during the transition from the deployed configuration of FIG. 9*a* to the furled configuration of FIG. 9*d*.

In order for the distal end ED to move closer to the axis x by rotation with respect to the slider 52, when the slider 52 advances along the axis x during the transition from the deployed configuration to the furled configuration, the guiding device advantageously comprises drive means or coupling means able simultaneously to generate a movement of the slider 52 toward the front AV, a rotation of the arm about the axis of the pivot connection connecting the proximal end EP to the slider 52 in a defined direction such that the distal end ED of the arm 51 moves closer to the axis x, and vice versa.

In the particular example of FIGS. 9*a* to 9*d*, the proximal end EP of each arm 51 is mounted on a slider 52 mounted with the ability to slide with respect to the body 7 of the docking station along the longitudinal axis x. The proximal end EP of each arm 51 is mounted on the slider 52 by a pivot connection that is fixed with respect to the slider 52 and with the pivot connection having an axis of rotation substantially tangential to the axis x. The drive means comprise forks 53 in the form of connecting arms distributed angularly about the longitudinal axis x. Each fork 53 is connected to one of the arms 51. A first longitudinal end E1 of the fork 53 coupled to an arm 51 is connected to the arm 51 by a first pivot connection of axis substantially tangential to the axis x positioned between the proximal end EP and the distal end ED of the arm 51. A second longitudinal end E2 of the fork 53 is connected to the body 7 by a second pivot connection of axis substantially tangential to the axis x. The second end E2 of the fork is positioned behind the slider 52 along the axis x. In this way, when the set E of arms 51 is in the deployed configuration, a translational movement of the slider 52 with respect to the body 7 toward the front AV along the axis x gives rise, through the articulations of the forks to the arms, to a forward translational movement of the arms 51 combined with a moving of the distal ends of each arm 51 of the set closer to the axis x.

In a variant, the proximal end of each of the arms is mounted on a connecting rod which causes it to move in a curved line during the transition from the deployed position to the furled position. Each arm advances forward with respect to the stop during the transition from the deployed position to the furled position, but the movement of the proximal end is not a movement of sliding along the axis x.

In another variant, the arms for example exhibit a length that is variable; they are mounted on the body 7 and can be controlled, and preferably are controlled, in such a way that the distal ends ED of the arms advance during the transition from the deployed configuration to the furled configuration.

For example, each arm is connected to the body by its proximal end EP. The proximal end EP is fixed in terms of translation along the longitudinal axis x, with respect to the body, and mounted with the ability to pivot with respect to the stop in such a way that the distal end ED moves closer to the axis x through rotation of the proximal end with respect to the stop during the transition from the deployed configuration to the furled configuration, and each arm is controlled in such a way that its distal end ED advances during transition from the deployed configuration to the furled configuration. In this way, each arm is controlled in such a way that its length decreases as the distal end moves closer to the axis x.

In another embodiment depicted in FIGS. 10*a* to 10*e*, each arm 151 is connected to the body 7 by its proximal end EPb. The proximal end EPb is fixed in terms of translation along the longitudinal axis x with respect to the body 7.

Figure 10A:
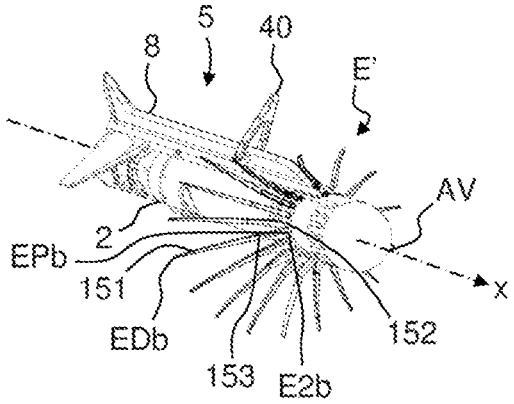
Figure 10B:
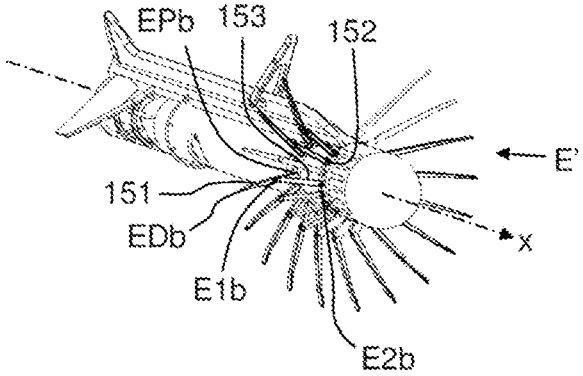

The proximal end EPb of the arm 151 is mounted with the ability to pivot with respect to the stop 9 in such a way that the distal end EDb is able to move closer to or does move closer to the axis x and advance along the axis x, through rotation of the proximal end EPb with respect to the stop 9 during the transition from the deployed configuration of FIG. 10*a* to the furled configuration of FIG. 10*f*.

The proximal end EPb of each arm 151 is connected to the body 7 by a pivot connection the axis of rotation of which is fixed with respect to the body 7 and positioned in such a way that the rotation of the arm 151 about this axis of rotation causes the distal end EDb to transition from its deployed-configuration position in which the end EDb is to the rear of the proximal end EPb and at a first distance away from the axis x, as far as its furled-configuration position in which it is situated in front of the distal end EDb at a second distance from the axis x that is shorter than the first distance. The proximal end EPb is situated between the position of the distal end EDb in the deployed configuration and the position of the distal end EDb in the furled configuration along the axis x. In other words, during the transition from the deployed configuration to the furled configuration and vice versa, the arms 151 turn over. The set E' of arms 151 transitions from the deployed configuration, in which the arms 151 delimit a volume that flares toward the rear of the body 7 to an intermediate configuration in which they delimit a volume that flares towards the front AV, the distal ends EDb of the arms 151 then moving closer to the axis x to reach the furled configuration.

The guidance device comprises drive means for bringing about the furling of the set of arms from its deployed configuration, and vice versa.

The axis of rotation is, for example, tangential to the axis x.

In the particular example of FIGS. 10*a* to 10*e*, the drive means comprise a slider 152 mounted with the ability to slide on the body 7 along the longitudinal axis x and forks 153, in the form of connecting arms, angularly distributed about the axis x. Each fork is connected to one of the arms. A first longitudinal end E1*b* of the fork 153 is connected to one of the arms 151 by a pivot connection of axis substantially tangential to the axis x positioned between the proximal end EPb and the distal end EDb of the arm 151. A second longitudinal end E2*b* of the fork 153 is connected to the slider 152 by a pivot connection of axis substantially tangential to the axis x. The slider 152 is positioned in front of the proximal end EPb of the arm 151 along the axis x. In that way, when the set of arms is in the deployed configuration, a translational movement of the slider 152 toward the front of the body 7, through the articulations of the fork 153 to the slider 152 and to the arms 151, gives rise to the rotation of the arms about their respective axes of rotation with respect to the body 7 from their respective positions in the furled configuration to their respective positions in the furled configuration.

In the two embodiments of the figures, the drive means comprise an actuator configured to drive the joint center 52 or 152 in translation along the axis x with respect to the body 7 so as to cause the set of arms to transition from the furled configuration to the deployed configuration. The actuator is, for example, of the hydraulic or electric ram type or of the torque motor type.

The slider 52, 152 exhibits, for example, substantially the shape of a circular ring positioned in a plane perpendicular to the axis x, the axis x passing through the center of the ring, the proximal ends EP, EPb are, for example, distributed on the circle perpendicular to the axis x and centered on the axis x. The forks 53, 153 all have the same length and the first ends of the forks are distributed on a circle perpendicular to the axis x and passing through the center of the circle and the seconds ends of the forks are distributed on another circle perpendicular to the axis x passing through the center of the circle. The arms all have the same length. In a variant, the arms and/or the forks may have different lengths, the proximal ends of the forks are not necessarily distributed on the circles, the joint center does not necessarily have the shape of a ring and the axes of the pivot connections are not necessarily tangential to the axis x. Different arms may thus be connected to the body 7 differently and driven by different drive means.

Figure 10C:
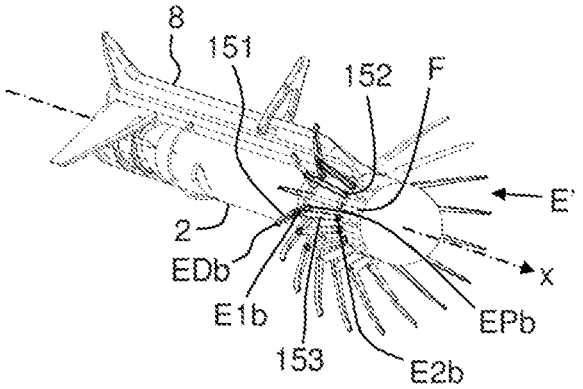
Figure 10D:
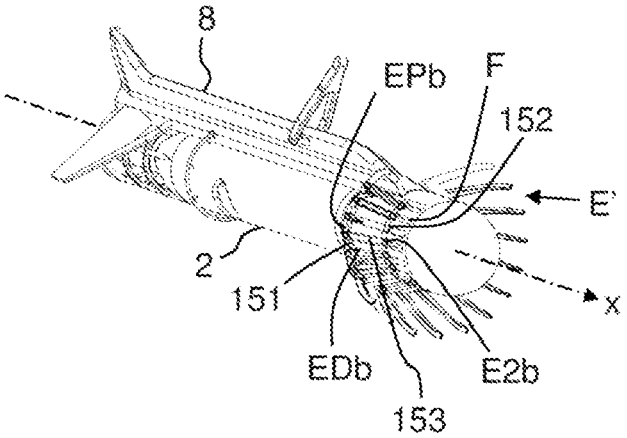

Advantageously, the body 7 comprises slots F visible in FIGS. 10*c* and 10*d* extending longitudinally parallel to the axis x and in which the distal ends EDb of the arms 151 are housed, in the furled configuration. That encourages the compactness of the assembly, improves the equilibrium of the AUV on a support of complementing shape, and protects the arms 151 from knocks while the guiding device is being recovered by a device of the crane type and while the AUV is being set down on a support. Slots may also be present in the embodiment of FIGS. 9*a* to 9*d*.

Advantageously, the arms 151 are fully housed in the slots in the furled configuration.

Figure 10E:
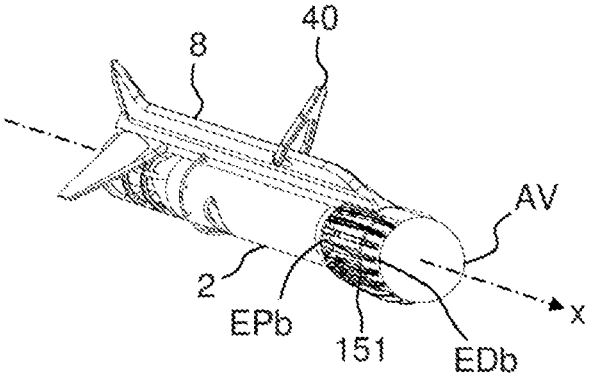

Advantageously, the arms 51, 151 are mounted on the body 7 in such a way as to extend essentially in front of the stop 9 in the furled configuration of FIG. 9*d*, 10*e*.

Advantageously, the arms 51, 151 extend essentially behind the stop 9 in the deployed configuration of FIG. 9*a*, 10*a*.

The first embodiment is particularly advantageous. It consumes very little energy because, in the transition from the deployed configuration to the furled configuration, the arms do not pass through an intermediate position in which they are substantially perpendicular to the axis x and therefore to the flow of water around the station. Now, that position is the position in which the drag is the greatest. This solution also limits the instabilities of the recovery station following recovery of the underwater vehicle and during the phases of the furling and deploying the arms. Furthermore, this solution limits the risks of marine bodies becoming caught on the arms. These bodies would be liable to weaken the arms and prevent an underwater vehicle from passing between and being recovered by the arms or liable to destabilize the recovery station prior to and after the recovery of the underwater vehicle. This solution is therefore robust.

This solution also offers the advantage of being compact. It can be actuated in a compact way, for example during test or maintenance phases, when the docking station is onboard the carrying vehicle or in a workshop.

Advantageously, as visible in FIG. 5, the set E of arms 51 comprises a set of at least one lower arm BI belonging to the lower part PI in the deployed configuration and having a density greater than 1 kg/m3. This feature limits the risks of tilting of the docking station.

In the nonlimiting case in which the set of arms 51 comprises a set of at least an upper arm BS belonging to the upper part PS in the deployed configuration, the mean density of each arm of the set of at least one lower arm is greater than the mean density of each arm of the set of at least one upper arm. This feature further limits the risks of tilting of the docking station.

In the embodiments of the figures, the arms have a fixed length.

As a variant, the arms have a variable length. Advantageously, the length of each arm can be adjusted independently of the inclination of the arm with respect to the axis x, namely independently of the distance separating the distal end of the arm from the axis x, and the set is able to be in a number of different deployed configurations. That means that the angular aperture and the length, along the axis x, of the volume delimited by the arms can be selected according to the sea state. In rough seas, it is possible to increase the length of this volume.

The arms are, for example, telescopic.

This variant can be applied to the first and second embodiment.

The set of arms may comprise at least one arm of which the dynamics are in accordance with the first embodiment and/or at least one arm of which the dynamics are in accordance with the second embodiment.

The guiding device may comprise only the set of arms able to be in the deployed configuration and in the furled configuration. In a variant, the guiding device may comprise another set of at least one fixed guiding arm able to guide the underwater vehicle toward the stop.

The invention also relates to an underwater assembly comprising the AUV and the docking device.

The docking station advantageously has a length similar to or greater than that of the AUV.

The mass of the AUV is preferably higher than that of the docking station.

The docking station depicted in the figures is hauled by the carrying vessel 3 via a cable 4.

In a variant, the docking station is fixed to the hull of the carrying vessel or is connected to the carrying vessel by an arm.

In one embodiment of the invention, the underwater vehicle comprises one or more sonar antennas. The underwater vehicle may comprise at least one sonar antenna for receiving acoustic signals and/or at least one sonar antenna for emitting acoustic signals.

Advantageously, at least one sonar antenna is positioned in such a way that the arms of the set of arms are unable to be situated in a zone of coverage of the antenna, namely facing the antenna, when the antenna is in abutment against the stop, the set of arms being in the furled configuration. What is meant by zone of coverage is a zone in which the antenna is intended to emit or receive acoustic signals.

By contrast, the sonar antenna considered is positioned in such a way as to be able to be situated facing at least one of the arms of the set when the underwater vehicle is in abutment against the stop, when the arms are situated in the deployed configuration.

This ability may be dependent upon the list of the underwater vehicle and of the docking station when the underwater vehicle is in abutment against the stop. For example, at least one of the arms faces the sonar antenna, namely lies in a zone of coverage of the sonar antenna, when the set of arms is in the deployed configuration, the underwater vehicle being in abutment against the stop, the underwater vehicle and the docking station each having a predetermined list, each arm being situated outside of the zone of coverage of the antenna when the set of arms is in the furled configuration, the underwater vehicle being in abutment against the stop, the underwater vehicle and the docking station each having a predetermined list.

The dynamics of the arms according to the invention are particularly well suited to this configuration.

The invention therefore allows the sonar mission to be continued using the sonar antenna even when the arms are in the furled configuration.

This is particularly true when the docking station is being hauled by a carrying vessel via the cable 4.

This is also true when the docking station is fixed to the carrying vessel.

The invention claimed is:

1. A docking device for an underwater vehicle, the docking device comprising a docking station able to be connected to a carrying vessel, the docking station comprising a body comprising a stop allowing a movement of the underwater vehicle with respect to the body along a longitudinal axis (x) passing through the stop to be blocked, in a direction directed from the rear forward defined by the longitudinal axis (x), the docking station comprising a guiding device comprising a set (E) of arms which are connected to the body and each comprising a distal end (ED) and a proximal end (EP), the arms being distributed around the stop, the set (E) of arms being able to be in a deployed configuration wherein it delimits a volume that flares toward the rear so as to allow the underwater vehicle to be guided toward the stop, the distal end (ED) of each arm being situated behind the proximal end (EP) of the arm in the deployed configuration, the set (E) of arms being able to be in a furled configuration wherein a distal end (ED) of each arm of the set (E) of arms is closer to the longitudinal axis (x) than in the deployed configuration and wherein the distal end (ED) is situated forward of the position occupied by the distal end (ED) in the deployed configuration so that a length, along the axis x, of a volume delimited by the set (E) of arms behind the stop is shorter in the furled configuration than in the deployed configuration.

2. The docking device as claimed in claim 1, wherein the docking station comprises locking means allowing the underwater vehicle, butting against the stop to be secured to the body.

3. The docking device as claimed in claim 1, wherein at least one arm of the set is mounted on the body and configured and/or controlled in such a way that the distal end ED of the arm advances forward while constantly remaining behind the proximal end EP, during the transition from the deployed configuration to the furled configuration.

4. The docking device as claimed in claim 3, wherein the arm is mounted on the body in such a way that the arm advances forward, with respect to the stop, during the transition from the deployed configuration to the furled configuration.

5. The docking device as claimed in claim 4, wherein at least one arm of the set (E) is mounted with the ability to slip with respect to the stop along the axis (x) in such a way that the arm experiences a forward translational movement with respect to the stop during the transition from the deployed configuration to the furled configuration.

6. The docking device as claimed in claim 5, wherein the proximal end (EP) of the arm is mounted with the ability to pivot on a slider mounted with the ability to slide with respect to the stop along the axis (x) in such a way that the distal end (ED) is able to move closer to the axis x, through the rotation of the arm with respect to the slider, as the slider advances along the axis (x) during the transition from the deployed configuration to the furled configuration.

7. The docking device as claimed in claim 1, wherein the proximal end (EPb) of at least one arm of the set is fixed in terms of translation along the longitudinal axis with respect to the stop.

8. The docking device as claimed in claim 7, wherein the proximal end (EPb) of the arm is mounted with the ability to pivot with respect to the stop in such a way that the distal end (EDb) is able to move closer to the axis x and to advance along the axis x, by rotation of the proximal end (EPb) with respect to the stop during the transition from the deployed configuration to the furled configuration.

9. The docking device as claimed in claim 1, wherein the body comprises slots that are elongate along the axis x, accepting the distal ends (ED) of the arms in the furled configuration.

10. The docking device as claimed in claim 1, wherein the body comprises a beam extending longitudinally parallel to the longitudinal axis (x) rearward away from the stop.

11. The docking device as claimed in claim 1, wherein at least one arm has a length that is variable independently of an inclination of the arm with respect to the axis x.

12. The docking device as claimed in claim 1, comprising a cable connected to the docking station and intended to connect the docking station to the carrying vessel.

13. A docking assembly comprising a docking device as claimed in claim 12 and a carrying vessel, the cable connecting the docking station to the carrying vessel so as to allow the carrying vessel to haul the docking station fully submerged.

14. An underwater assembly comprising a docking device as claimed in claim 1 and the underwater vehicle, the underwater vehicle comprising a sonar antenna arranged in such a way that at least one arm of the set is able to be in a zone of coverage of the sonar antenna when the underwater vehicle is in abutment against the stop, the set of arms being in the deployed configuration; the arms of the set of arms being unable to be in the zone of coverage of the sonar antenna when the set of arms is in the furled configuration.

* * * * *